US007258755B2

(12) United States Patent
Crafton et al.

(10) Patent No.: US 7,258,755 B2
(45) Date of Patent: Aug. 21, 2007

(54) INTEGRATED METAL PROCESSING FACILITY

(75) Inventors: Scott P. Crafton, Marietta, GA (US); Paul M. Crafton, Kennesaw, GA (US); James L. Lewis, Jr., Kennesaw, GA (US); Ian French, Kennesaw, GA (US)

(73) Assignee: Consolidated Engineering Company, Inc., Kennesaw, GA (US)

( * ) Notice: Subject to any disclaimer, the term of this patent is extended or adjusted under 35 U.S.C. 154(b) by 0 days.

(21) Appl. No.: 11/189,452

(22) Filed: Jul. 26, 2005

(65) Prior Publication Data

US 2005/0257858 A1 Nov. 24, 2005

Related U.S. Application Data

(62) Division of application No. 10/051,666, filed on Jan. 18, 2002, now abandoned.

(60) Provisional application No. 60/266,357, filed on Feb. 2, 2001.

(51) Int. Cl.
*B22D 29/00* (2006.01)

(52) U.S. Cl. ..... 148/540; 148/549

(58) Field of Classification Search ..... 148/540, 148/549, 538

See application file for complete search history.

(56) References Cited

U.S. PATENT DOCUMENTS

| | | | | |
|---|---|---|---|---|
| 2,385,962 | A | 10/1945 | Barnett | 34/13 |
| 2,813,318 | A | 11/1957 | Horth | 22/89 |
| 2,988,351 | A | 6/1961 | Barnett et al. | 263/40 |
| 3,194,545 | A | 7/1965 | Smith | 266/3 |
| 3,222,227 | A | 12/1965 | Baugh et al. | 148/11.5 |
| 3,432,368 | A | 3/1969 | Nakamura | 148/12 |
| 3,534,946 | A | 10/1970 | Westerkamp et al. | 263/28 |
| 3,604,695 | A | 9/1971 | Steeper | |
| 3,675,905 | A | 7/1972 | Placek | 263/2 |
| 3,737,280 | A | 6/1973 | Cromp | 432/14 |
| 3,760,800 | A | 9/1973 | Staffin et al. | 128/24.1 |
| 3,794,232 | A | 2/1974 | Petri | 226/50 |
| 3,856,583 | A | 12/1974 | Sanders et al. | 148/159 |
| 3,871,438 | A | 3/1975 | Vissers et al. | 164/5 |

(Continued)

FOREIGN PATENT DOCUMENTS

| | | | |
|---|---|---|---|
| CA | 1197981 | 12/1985 | 38/18 |

(Continued)

OTHER PUBLICATIONS

Economical Used Energy Type Continuing Heat Treating Furnace For Aluminum Castings Dogyo—Kanetsu vol. 21 No. 2 pp. 29-36—Mar. 1984.

(Continued)

*Primary Examiner*—Scott Kastler
(74) *Attorney, Agent, or Firm*—Womble Carlyle Sandridge & Rice, PLLC

(57) ABSTRACT

An integrated metal processing facility in which molten metal is poured into a series of molds at a pouring station to form metal castings, which are then transferred to a heat treatment line. Prior to introduction of the castings into a heat treatment station of the heat treatment line, the castings are subjected to heating sufficient to arrest cooling of the castings at or above a process control temperature for the metal thereof.

20 Claims, 8 Drawing Sheets

U.S. PATENT DOCUMENTS 3,977,911 A * 8/1976 Takase ..... 148/538
3,996,412 A 12/1976 Schaefer et al. ..... 13/20
4,021,272 A 5/1977 Asai et al. ..... 148/15
4,027,862 A 6/1977 Schaefer et al. ..... 266/160
4,068,389 A 1/1978 Staffin et al. ..... 34/57 A
4,098,624 A 7/1978 Laird, Jr. ..... 148/153
4,140,467 A 2/1979 Ellison et al. ..... 432/72
4,161,389 A 7/1979 Staffin et al. ..... 432/58
4,177,085 A 12/1979 Chadwick et al. ..... 148/2
4,177,952 A 12/1979 Rikker ..... 241/40
4,211,274 A 7/1980 Slowinski et al. ..... 164/401
4,242,077 A 12/1980 Hyre ..... 431/19
4,255,133 A 3/1981 Tanifuji et al. ..... 432/24
4,257,767 A 3/1981 Price ..... 432/24
4,294,436 A 10/1981 Takahashi ..... 266/257
4,325,424 A 4/1982 Scheffer ..... 164/5
4,338,077 A 7/1982 Shibayama et al. ..... 432/11
4,340,433 A 7/1982 Harding ..... 148/16
4,357,135 A 11/1982 Wilde et al. ..... 432/11
4,392,814 A 7/1983 Harding ..... 431/170
4,411,709 A 10/1983 Nakanishi ..... 148/3
4,415,444 A 11/1983 Guptail ..... 209/3
4,419,143 A 12/1983 Ito et al. ..... 148/3
4,420,345 A 12/1983 Ito et al. ..... 148/3
4,457,352 A 7/1984 Scheffer ..... 164/5
4,457,788 A 7/1984 Staffin et al. ..... 148/20.3
4,457,789 A 7/1984 Wilks ..... 148/134
4,478,572 A 10/1984 Selli ..... 432/13
4,490,107 A 12/1984 Kimura et al. ..... 422/11
4,499,940 A 2/1985 Hall ..... 164/36
4,512,821 A 4/1985 Staffin et al. ..... 148/16.5
4,519,718 A 5/1985 Staffin et al. ..... 374/45
4,524,957 A 6/1985 Staffin et al. ..... 266/252
4,544,013 A 10/1985 Kearney et al. ..... 164/5
4,577,671 A 3/1986 Stephan ..... 164/401
4,579,319 A 4/1986 Sasaki ..... 266/252
4,582,301 A 4/1986 Wunning ..... 266/87
4,604,055 A 8/1986 Mackenzie ..... 432/58
4,606,529 A 8/1986 Tooch ..... 266/80
4,613,713 A 9/1986 Staffin et al. ..... 585/241
4,620,586 A 11/1986 Musschoot ..... 164/253
4,620,884 A 11/1986 Heath ..... 148/128
4,623,400 A 11/1986 Japka et al. ..... 148/6.35
4,648,836 A 3/1987 Thom ..... 432/107
4,671,496 A 6/1987 Girrell et al. ..... 266/78
4,681,267 A 7/1987 Leidel et al. ..... 241/23
4,700,766 A 10/1987 Godderidge ..... 164/5
4,752,061 A 6/1988 Dalton et al. ..... 266/87
4,779,163 A 10/1988 Bickford et al. ..... 361/212
4,817,920 A 4/1989 Erfort, Jr. ..... 266/252
4,830,605 A 5/1989 Hodate et al. ..... 431/170
4,832,764 A 5/1989 Merz ..... 148/131
4,878,952 A 11/1989 Pillhoefer ..... 148/1
4,955,425 A 9/1990 McKenna ..... 164/269
5,018,707 A 5/1991 Hemsath et al. ..... 266/254
5,108,519 A 4/1992 Armanie et al. ..... 148/12.7 A
5,108,520 A 4/1992 Liu et al. ..... 148/12.7 R
5,115,770 A 5/1992 Yen et al. ..... 123/193.6
5,120,372 A 6/1992 Yen et al. ..... 420/537
5,156,800 A 10/1992 Buchet et al. ..... 266/99
5,169,913 A 12/1992 Staffin et al. ..... 526/65
5,178,695 A 1/1993 LaSalle et al. ..... 148/698
5,226,983 A 7/1993 Skinner et al. ..... 148/549
5,251,683 A 10/1993 Backer ..... 164/98
5,253,698 A 10/1993 Keough et al. ..... 164/269
5,294,094 A 3/1994 Crafton et al. ..... 266/44
5,306,359 A 4/1994 Eppeland et al. ..... 148/511
5,308,410 A 5/1994 Hurimura et al. ..... 148/561
5,312,498 A 5/1994 Anderson ..... 148/695
5,336,344 A 8/1994 Wei ..... 148/549
5,340,089 A 8/1994 Heath et al. ..... 266/87
5,340,418 A 8/1994 Wei ..... 148/549
5,350,160 A 9/1994 Crafton et al. ..... 266/252
5,354,038 A 10/1994 Crafton ..... 266/44
5,378,434 A 1/1995 Staffin et al. ..... 422/141
5,423,370 A 6/1995 Bonnemersou et al. ..... 164/132
5,439,045 A 8/1995 Crafton ..... 164/5
5,485,985 A 1/1996 Eppeland et al. ..... 266/87
5,514,228 A 5/1996 Wyatt-Mair et al. ..... 148/551
5,518,557 A 5/1996 Jones et al. ..... 148/511
5,531,423 A 7/1996 Crafton et al. ..... 266/44
5,536,337 A 7/1996 Wei ..... 148/549
5,547,228 A 8/1996 Abbema et al. ..... 148/16
5,547,523 A 8/1996 Blankenship, Jr. et al. . 148/677
5,551,670 A 9/1996 Heath et al. ..... 266/87
5,551,998 A 9/1996 Crafton et al. ..... 148/538
5,565,046 A 10/1996 Crafton et al. ..... 148/538
5,571,347 A 11/1996 Bergsma ..... 148/550
5,593,519 A 1/1997 Blankenship, Jr. et al. . 148/514
5,643,372 A 7/1997 Sainfort et al. ..... 148/699
5,738,162 A 4/1998 Crafton ..... 164/5
5,829,509 A 11/1998 Crafton ..... 164/5
5,850,866 A 12/1998 Crafton ..... 164/5
6,112,803 A 9/2000 Kruger ..... 164/103
6,217,317 B1 4/2001 Crafton et al. ..... 432/128
6,325,873 B1 12/2001 Pollkoetter ..... 148/552
6,672,367 B2 1/2004 Crafton et al.
6,901,990 B2 * 6/2005 Howard et al. ..... 164/76.1
2002/0104596 A1 8/2002 Crafton et al.
2004/0035546 A1 2/2004 DiSerio
2005/0072549 A1 4/2005 Crafton et al.
2005/0257858 A1 11/2005 Crafton et al.
2005/0269751 A1 12/2005 Crafton et al.

FOREIGN PATENT DOCUMENTS

DE 2307773 2/1973
DE 2323805 5/1973
DE 2310541 9/1973
DE 2315958 4/1974
DE 2337894 11/1974
DE 2914221 4/1979
DE 3206048 2/1982
DE 4012158 11/1990 ..... 164/5
DE 195 30 975 2/1997
EP 0546210 A1 6/1993
EP 0 610 028 8/1994
FR 7043571 12/1970
FR 2448573 2/1979
GB 1392405 4/1975
GB 1564151 4/1980
GB 1569152 6/1980
GB 2187398 9/1987
GB 2230720 10/1990
JP 355149772 A * 11/1980
JP 5653867 5/1981
JP 5939464 8/1982
JP 5825417 2/1983
JP 5825860 2/1983
JP 59219410 12/1984
JP 6092040 5/1985 ..... 164/132
JP 2074022 9/1985
JP 62110248 5/1987
JP 6316853 1/1988 ..... 164/132
JP 63108941 5/1988
JP 1-91957 4/1989
JP 1-122658 5/1989
JP 2104164 8/1990
JP 3-465 1/1991
SU 1129012 7/1982
SU 0234810 3/1985 ..... 164/132
WO WO97/30805 8/1997
WO WO98/14291 4/1998
WO WO 00/36354 6/2000

WO WO 02/063051 A2 8/2002

OTHER PUBLICATIONS

Brochures describing Beardsley & Pipe PNEU-Reclaim Sand Reclamation Units Prior to Aug. 13, 1992.
Brochure describing Fataluminum Sand Reclamation Units—Prior to Aug. 13, 1992.
Paul M. Crafton —Heat Treating Aging System Also Permits Core Sand Removal—Reprinted from Sep. 1989 Modern Castings magazine.
ASM Handbook, vol. 4 Heat Treating, pp. 465-474, Apr. 1993.
The Making, Shaping and Treating of Steel, 10th edition, pp. 1267-1276, Dec. 1989.
Sales brochure describing Thermfire Brand Sand Reclamation, Gudgeon Bros., Ltd. believed to be known to others prior to Sep. 1989.
Sales brochure describing Simplicity/Richards Gas-Fired Thermal Reclamation System Simplicity Engineering, Inc.—believed to be known to others prior to Sep. 1989.
Sales brochure describing AirTrac Brand Fluidizing Conveyor, Air Trac Systems Corp., believed to be known to others prior to Sep. 1989.
Sales brochure describing Fluid Bed Calcifer Thermal Sand Reclamation Systems, Dependable Foundry Equipment Co.—Believed to be known to others prior to Sep. 1989.
Foundry Management & Technology—Dec. 1989—vol. 117; No. 12; p. G3—Shakeout/Cleaning/Finishing Brochure.
Lampman S.R. & Zorc T.B.: "ASM Handbook—Heat Treating, vol. 4" 1991, ASM International, USA, XP-002357244—pp. 529-541.

* cited by examiner

INCINERATOR
QUENCH STATION
HEAT TREATMENT STATION
PROCESS TEMPERATURE CONTROL STATION
TRANSFER MECHANISM
HEAT TREATMENT STATION
HEAT TREATMENT STATION
CHILL REMOVAL

INTEGRATED METAL PROCESSING FACILITY

CROSS REFERENCE TO RELATED APPLICATION

This application is a Divisional application of U.S. application Ser. No. 10/051,666, filed Jan. 18, 2002, now abandoned, which claims the benefit of U.S. Provisional Application Ser. No. 60/266,357, filed Feb. 2, 2001.

TECHNICAL FIELD

This invention generally relates to metallurgical casting and treatment processes, and more specifically to an integrated metal processing facility and method of heat treating castings.

BACKGROUND OF THE INVENTION

Traditionally, in conventional processes for forming metal castings, a mold such as a metal die or sand mold having an interior chamber with the exterior features of a desired casting defined therein, is filled with a molten metal. A sand core that defines interior features of the casting is received and or positioned within the mold to form the interior detail of the casting as the molten metal solidifies about the core. After the molten metal of the casting has solidified, the casting generally is thereafter moved to a treatment furnace (s) for heat treatment of the castings, removal of sand from the sand cores and/or molds, and other processes as required. The heat treatment processes condition the metal or metal alloys of the castings so that they will be provided with desired physical characteristics suited for different applications.

Typically, during the transfer of the castings from the pouring station to a heat treatment station, and especially if the castings are allowed to sit for any appreciable amount of time, the castings are generally exposed to the ambient environment of the foundry or metal processing facility. As a result, the castings tend to begin to rapidly cool down from a molten or semi-molten temperature. While some cooling of the castings is necessary to cause the castings to solidify, the present inventors/applicants have found that the more that the temperature of the castings drops and the longer the castings remain below a process critical or process control temperature of the castings, the more heat treatment time within the heat treatment furnace that is required to both heat the castings back up to a desired heat treatment temperature and hold the castings at said temperature for heat treating the castings to achieve the desired physical properties thereof.

It has been found that for certain types of metals, for every minute of time that the casting drops below its process control temperature, as much as 4 minutes or more of extra heat treatment time is required to achieve the desired process. Thus, even dropping below for as little as ten minutes below the process control temperature of the metal of the castings can require as much as 40+ minutes of extra heat treatment time to achieve the desired treated physical properties. Typically, therefore, those castings are heat treated for at least 2-6 hours, and in some cases longer, to achieve the desired heat treatment effects. As a consequence, however, the longer the heat treatment time and the more heat required to properly and completely heat treat the castings, the greater the cost of the heat treatment process and the greater the waste of heat and energy.

Attempts have been made to shorten the distance between the pouring and heat treatment stations to try to reduce the loss of heat. For example, the Mercedes unit of Daimler Benz in Germany has placed a heat treatment furnace close to the take off or transfer points of a carousel type pouring station. As the castings reach a take-off point where they are removed from their dies, they generally are transported to a basket or carrier for collection of a batch of castings. The castings are then introduced into a heat treatment furnace for batch processing. The problem with this system is that it still fails to address the problem of the castings being subjected to the ambient environment, which generally is at temperatures much lower than the desired process control temperature of the castings, both during the transfer of the castings to a collection basket and while the castings sit in the basket awaiting introduction into the heat treatment furnace. This idle time can still be as much as 10 minutes or more depending upon the processing rates of the pouring and heat treatment stations. However, it is also important for the castings to be cooled and maintained at a temperature at or below the heat treatment temperature of the casting metal(s) for at least some desired time, in order to enable the castings to properly solidify prior to heat treatment. Thus, moving the castings from pouring to heat treatment too quickly can disrupt the formation of the castings and prevent them from properly solidifying.

There is, therefore, a desire in the industry to enhance the process of heat treating castings, such that a continuing need exists for a more efficient method and system or facility to enable more efficient heat treatment and processing of metal castings, and further potentially enable more efficient sand core and/or sand mold removal and reclamation.

SUMMARY OF THE INVENTION

Briefly described, the present invention generally comprises an integrated metal processing facility for pouring, forming, heat treating and further processing castings formed from metals or metal alloys. The integrated metal processing facility generally includes a pouring station at which a molten metal such as aluminum or iron, or a metal alloy, is poured into a mold or die, such as a permanent metal mold, semi permanent molds, or a sand mold. The molds then are transitioned from a pouring or casting position of the pouring station to a transfer position, whereupon the casting is either removed from its mold, or the mold, with the casting contained therewithin, is then transferred to a heat treatment line by a transfer mechanism. The transfer mechanism typically will include a robotic arm, crane, overhead hoist or lift, pusher, conveyor or similar conveying mechanism. In some embodiments, the same mechanism also can be used to remove the castings from their molds and transfer the castings to the heat treatment line. During this transition from pouring to the transfer position or point and/or to the heat treatment line, the molten metal of the castings is permitted to cool to an extent sufficient to enable the metal to solidify to form the castings therewithin.

The heat treatment line or unit generally includes a process temperature control station and a heat treatment station or furnace typically having one or more furnace chambers, and, in some embodiments, a quench station generally located downstream from the heat treatment station. The process temperature control station generally is formed as an elongated chamber or tunnel through which the castings are received prior to their introduction into the heat treatment station. The chamber of the process temperature control station typically includes a series of heat sources, such as radiant heaters, infrared, inductive, convection, conduction, or other types of heating elements mounted therealong so as to supply heat to create a heated environment therewithin. The walls and ceiling of the process temperature control station further typically are formed with or have a radiant material applied thereto, which material will tend to radiate or direct heat toward the castings and/or molds as they are passed through the chamber.

As the castings and/or the molds with the castings therein are received within and pass along the chamber of the process temperature control station, the cooling of the castings is arrested at or above a process control temperature. The process control temperature generally is a temperature below the solution heat-treat temperature required for the metal of the castings, such that the castings are cooled to a sufficient amount or extent to enable them to solidify, but below which the time required to raise the castings up to their solution heat treatment temperature and thereafter heat-treat the castings is exponentially increased. The castings are maintained at or above their process control temperature as they are passed along the process temperature control station prior to introduction into the heat treatment station.

Alternatively, a series of heat sources, including radiant heating elements such as infrared and inductive heating elements, convection, conduction or other types of heat sources can be positioned along the path of travel of the castings as they are transferred from the pouring station to the heat treatment line for feeding into the heat treatment station. For such an embodiment, the process temperature control station can be replaced with a series of heat sources mounted along the path of travel of the castings from the pouring station to the heat treatment furnace so as to direct heat, such as through the flow of heated air or other media, at the castings or molds as the castings or molds are fed from the pouring station into the heat treatment station. In addition, a heating element or heat source can be mounted directly to the transfer mechanism in a position so as to direct a flow of heat at or against the castings and/or the sand molds with the castings contained therein. Thus, the cooling of the castings below their process control temperature will be arrested by the application of heat directly from the transfer mechanism itself during the transfer and introduction of the castings from the pouring station directly into the heat treatment station.

By arresting the cooling of the castings and thereafter maintaining the castings at a temperature that is substantially at or above the process control temperature for the metal of the castings, the time required for the heat treatment of the castings can be significantly reduced as the castings can be rapidly brought up to a solution heat treatment temperature within a relatively short period of time after their introduction into the heat treatment station or furnace. Accordingly, the output of the pouring station for the castings can be increased, and thus the overall processing and heat treatment times for the castings can be enhanced or reduced.

As the castings are passed through the heat treatment station, they are maintained or soaked at a solution heat treatment temperature for a desired length of time as needed to completely and sufficiently heat treat the metal of the castings and for the breakdown and reclamation of the sand of the sand cores and sand molds of the castings. Thereafter, the castings can be passed through a quenching station, and further can be passed through an aging station for aging and additional treatment and processing of the casting.

Various objects, features, and advantages of the present invention will become apparent to those skilled in the art upon a review of the following detailed description when taken in conjunction with the accompanying drawings.

DETAILED DESCRIPTION OF THE INVENTION

Referring now in greater detail to the drawings in which like numerals refer to like parts throughout the several views, FIGS. 1A-3 schematically illustrate an integrated metal processing facility or system 5 and method of processing metallurgical castings. Metal casting processes are generally well known to those skilled in the art and a traditional casting process will be described only briefly for reference purposes. It will also be understood by those skilled in the art that the present invention can be used in any type of casting process, including metal casting processes for forming aluminum, iron, steel and/or other types of metal and metal alloy castings. The present invention thus is not and should not be limited solely for use with a particular casting process or a particular type or types of metals or metal alloys.

Figures 1A, 1B, 1C:
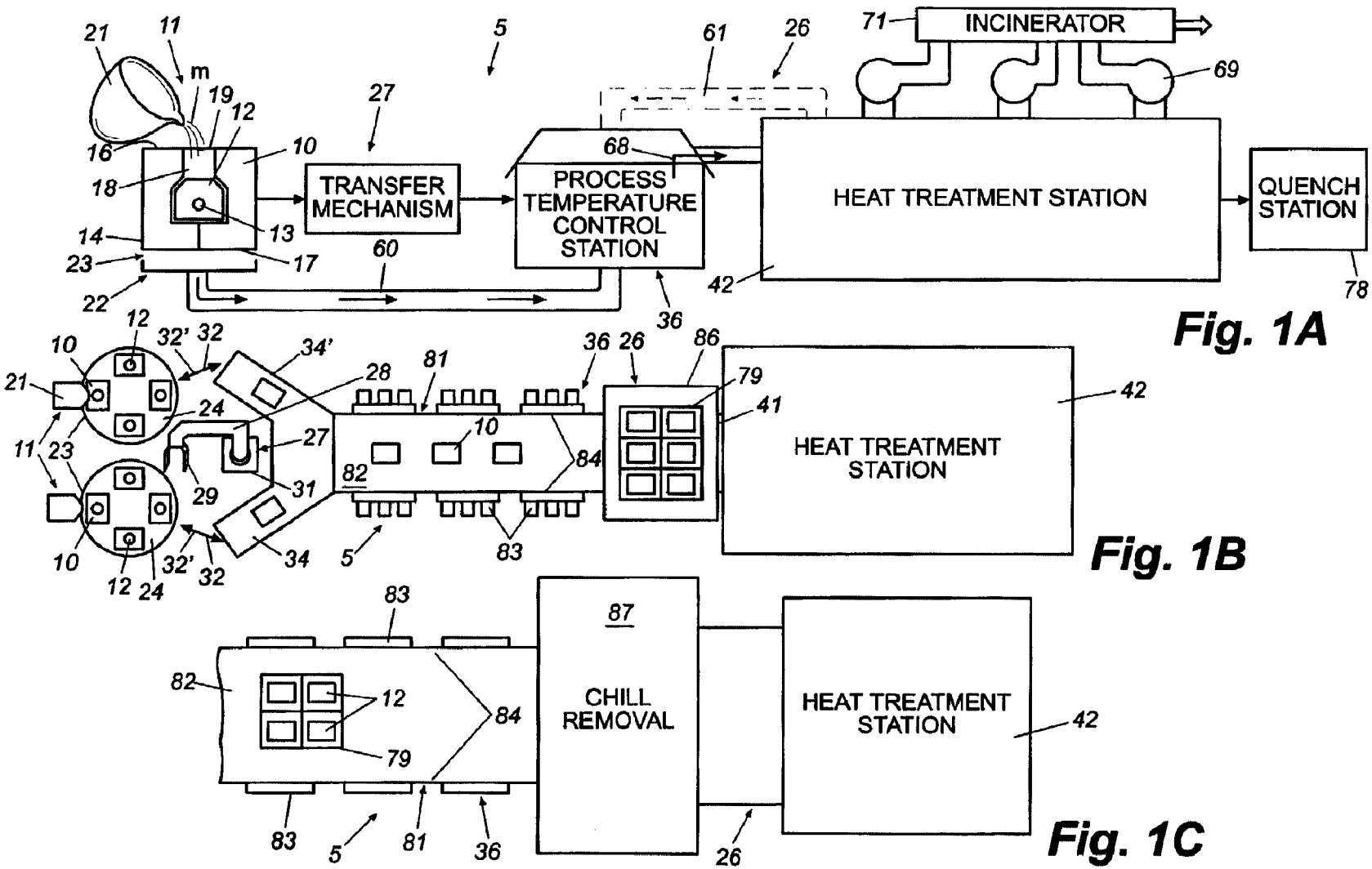
FIG. 1A is a schematic illustration of the integrated, multifunction metal processing facility, schematically illustrating the processing of castings according to the present invention.
FIG. 1B is a schematic illustration of an alternate embodiment of the present invention illustrating the collection and transfer of castings from multiple pouring stations to a heat treatment unit of the present invention.
FIG. 1C is a schematic illustration of another alternate embodiment of the present invention with chill removal from the molds.

As illustrated in FIG. 1A, typically, a molten metal or metallic alloy M is poured into a die or mold 10 at a pouring or casting station 11 for form a casting 12, such as a cylinder head or engine block or similar cast part. Typically, casting cores 13 formed from sand and an organic binder, such as a phenolic resin, are received or placed within the molds 10, so as create hollow cavities and/or casting details or core prints within the castings being formed within each mold. Each of the molds further can be a permanent, metal mold or die, typically formed from a metal such as steel, cast iron or other material as is known in the art, and having a clam-shell style design for ease of opening and removal of the casting therefrom. Alternatively, the molds can include "precision sand mold" type molds and/or "green sand molds", which molds generally are formed from a sand material such as silica sand or zircon sand, mixed with a binder such as a phenolic resin or other binder as is known in the art, similar to the sand casting cores 13. The molds further can include semi-permanent sand molds, which typically have an outer mold wall formed from sand and a binder material, a metal such as steel, or a combination of both types of materials.

It will be understood that the term "mold" will hereafter will generally be used to refer to all types of molds as discussed above, including permanent or metal dies, semi-permanent and precision sand mold type molds, and other metal casting molds except where a particular type mold is indicated. It further will be understood that in the various embodiments discussed below, unless a particular type of mold and/or heat treatment process is indicated, the present invention can be used for heat treating castings that have been removed from their permanent molds, or which remain within a sand mold for the combined heat treatment and sand mold break-down and sand reclamation.

As shown in FIG. 1A, each of the molds 10 generally includes side walls 14, an upper wall or top 16, a lower wall or bottom 17, which collectively define an internal cavity 18 in which the molten metal is received and formed into the casting 12. A pour opening 19 generally is formed in the upper wall or top 16 of each mold and communicates with the internal cavity for passage of the molten metal through each mold and into its internal cavity 18 at the pouring station 11. As indicated in FIGS. 1A-1C, the pouring station 11 generally includes a ladle or similar mechanism 21 for pouring the molten metal M into the molds and a conveyor 22, such as a carousel, piston, indexing or similar conveying mechanism, that moves one or more molds from a pouring or casting position, indicated by 23, at which the molten metal is poured into the molds, to a transfer point or position, indicated by 24, at which the castings are removed from their molds, or at which the molds with their castings therein are transferred from the pouring station to a heat treatment unit 26 or line for heat treatment. After the molten metal has been poured into its mold, the mold is conveyed to the transfer position, during which the metal is allowed to cool to a desired extent or temperature within the die as needed to enable the metal to solidify into the casting, after which the casting can be heat treated at a desired heat treatment temperature.

As the present Inventors have discovered, as the metal of the casting is cooled down, it reaches a process control temperature, below which the time required to both raise the castings back up to the heat treating temperature and perform the heat treatments is significantly increased. This process control temperature varies depending upon the metal and/or metal alloy being used to form the casting, ranging from temperatures of approximately 400° C. or lower for some alloys or metals, up to approximately 1000° C.-1300° C. or greater for other alloys of metals such as iron. For example, for aluminum/copper alloys, the process control temperature generally can range from about 400° C. to 470° C., which temperatures generally are below solution heat treatment temperatures for most copper alloys, which typically range from approximately 475° C. to approximately 495° C. While a casting is within its process control temperature range, it has been found that the casting typically will be cooled to a level sufficient to allow its metal to solidify as desired.

Figure 1D:
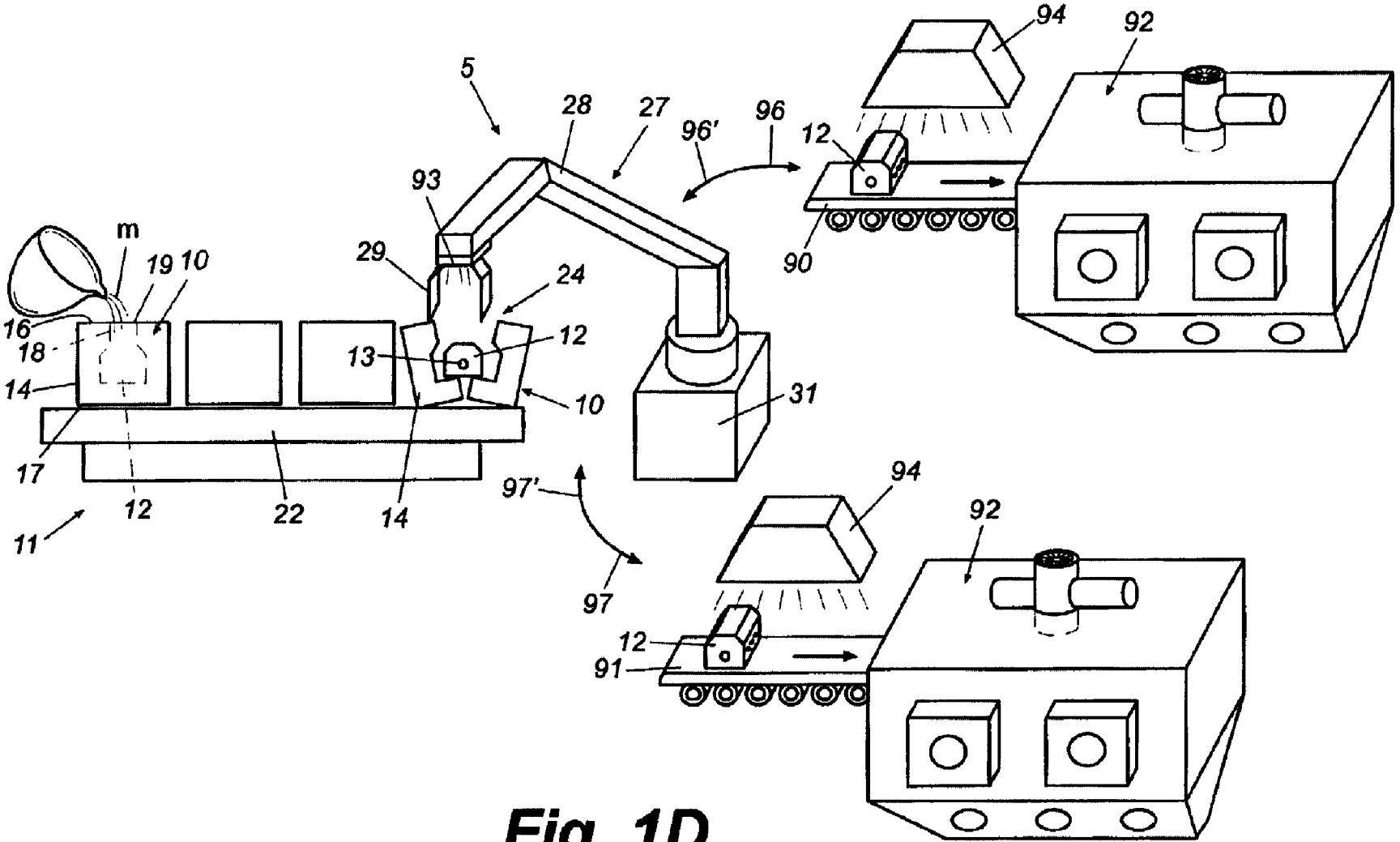
FIG. 1D is a schematic illustration of a further alternate embodiment of the present invention, illustrating the transfer and process heating of the castings by the transfer mechanism as the castings are transferred to the heat treatment unit.

However, it further has been discovered by the present Inventors that when the metal of the casting is permitted to cool below its process control temperature, it will be necessary to heat the casting for approximately an additional 4 minutes or more for each minute that the metal of the casting is cooled below the process control temperature thereof, in order to raise and maintain the temperature of the casting at a desired heat treatment temperature, such as for example, 475° C. to 495° C. for aluminum/copper alloys, or up to 510° C. to 570° C. for aluminum/magnesium alloys, so that heat treating can be performed. Thus, if the castings are permitted to cool below their process control temperature for even a short time, the time required to properly and completely heat treat the castings thereafter will be significantly increased. In addition, it should be recognized that in a batch processing type system, such as illustrated in FIGS. 1B, 1C and 1D, where several castings are being processed through the heat treatment station in a single batch, the heat treatment times for the entire batch of castings generally are based upon the heat treatment times required for the casting(s) with the lowest temperature in the batch. As a result, if one of the castings in the batch of castings being processed has been cooled to below its process control temperature for approximately 10 minutes, for example, the entire batch typically will be subjected to approximately 40 minutes or more of additional heat treatment time in order to ensure that all of the castings are properly and completely heat treated.

The present invention therefore is directed to an integrated processing facility or system 5 (FIGS. 1A-3) and methods of processing metal castings that are designed to move and/or transition the castings (within or apart from their molds) from the pouring station 11 to the heat treatment system or unit 26, with the cooling of the molten metal of the casting being arrested approximately at or above the process control temperature of the metal of the castings, but below or equal to the desired heat treatment temperatures thereof so as to accommodate the necessary solidification cooling of the castings and enable more efficient and shorter heat treatment times for the castings. It will be understood by those skilled in the art that the process control temperature for the castings being processed by the present invention will vary depending upon the particular metal and/or metal alloys being used for the castings. It will therefore also be understood that while the process control temperature for many metal and metal alloys generally will be within a range of approximately 400° C. for metals such as aluminum, up to approximately 1300° C. or greater for metals such as iron, greater or lesser temperatures also can be accommodated depending upon the casting material being processed.

Figure 2A:
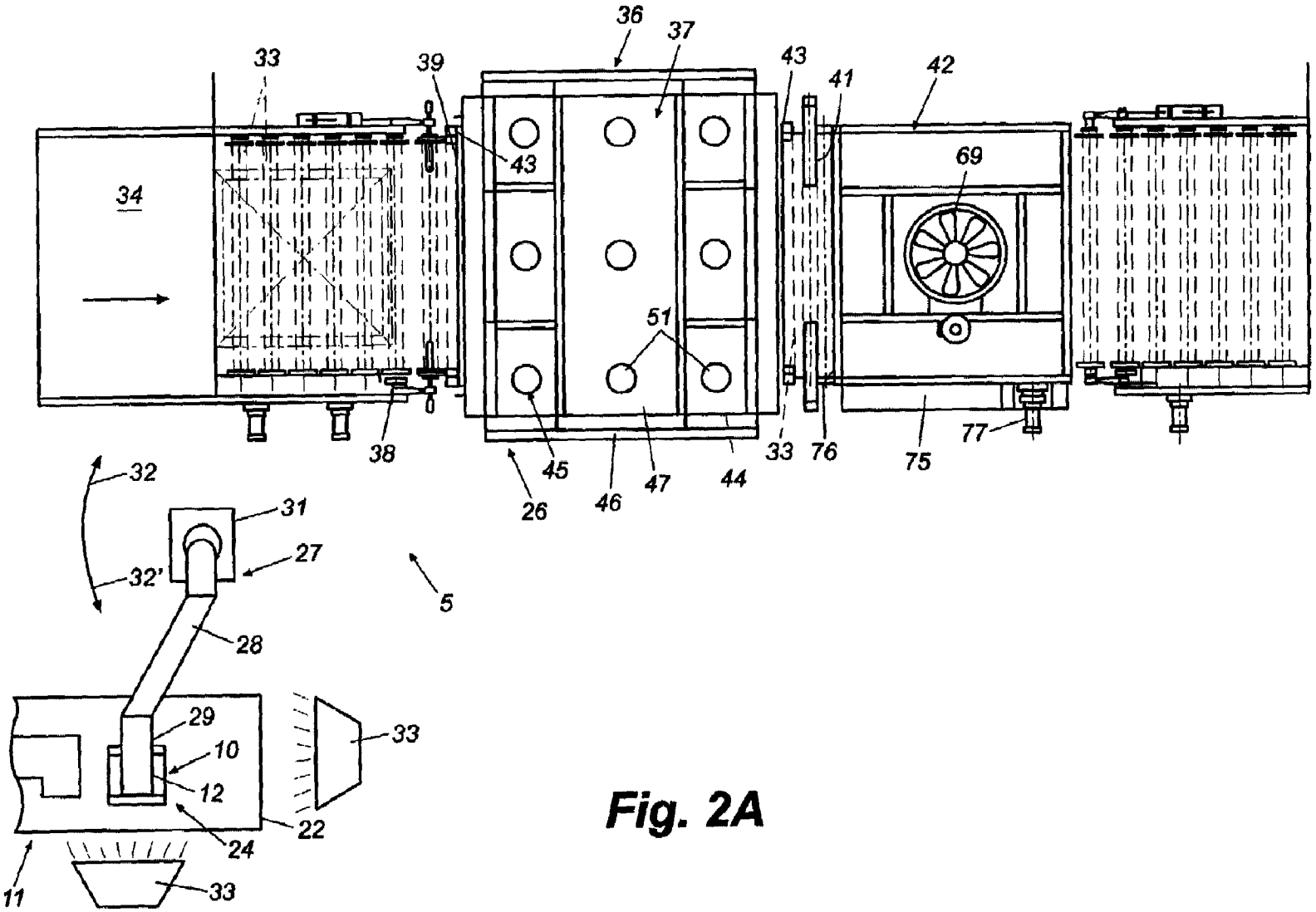
FIG. 2A is a top plan view of the process temperature control and heat treatment stations of the invention.
Figure 2B:
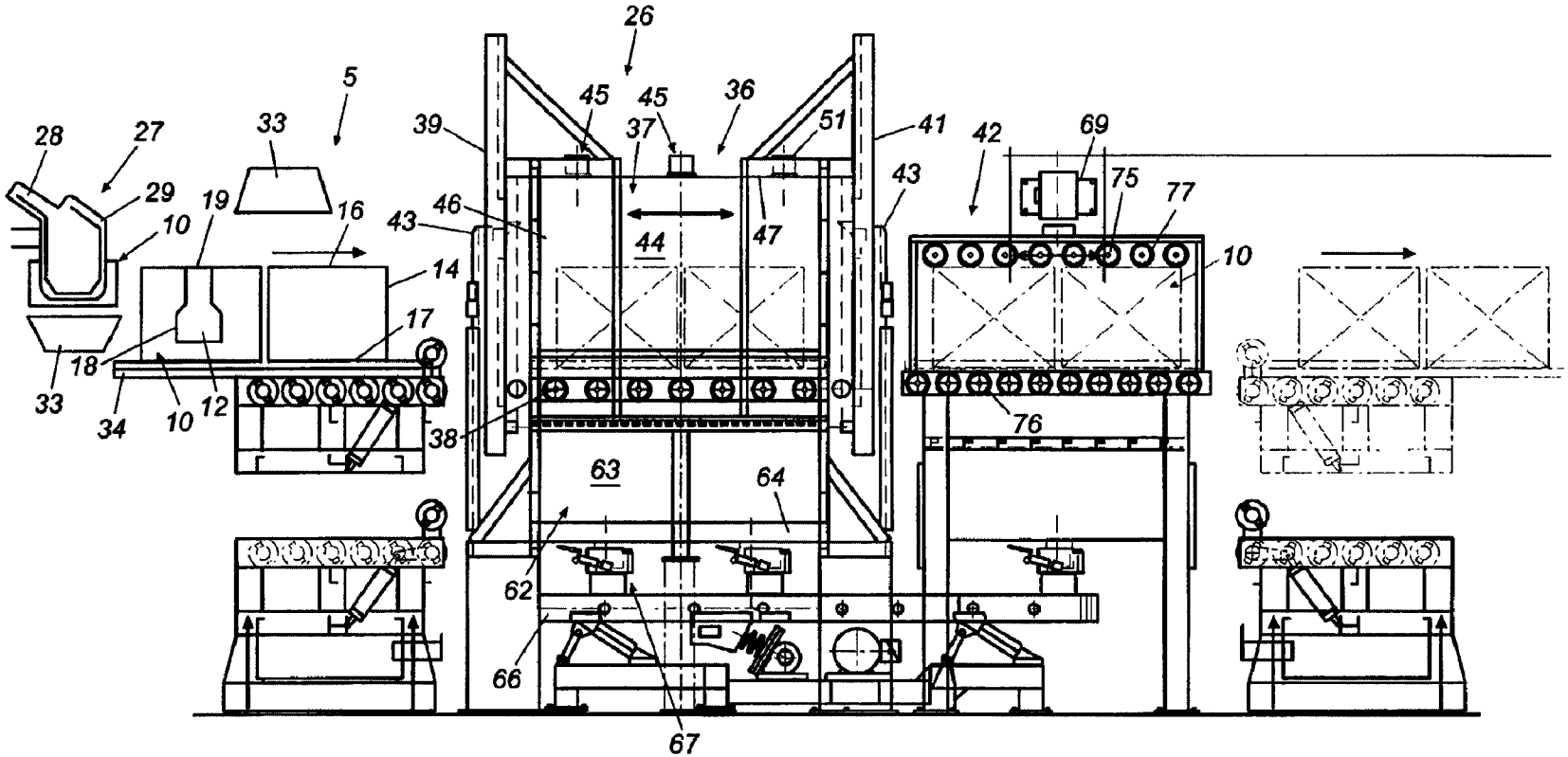
FIG. 2B is a side elevational view of the process temperature control and heat treatment stations of the invention illustrated in FIG. 2A.
Figure 3:
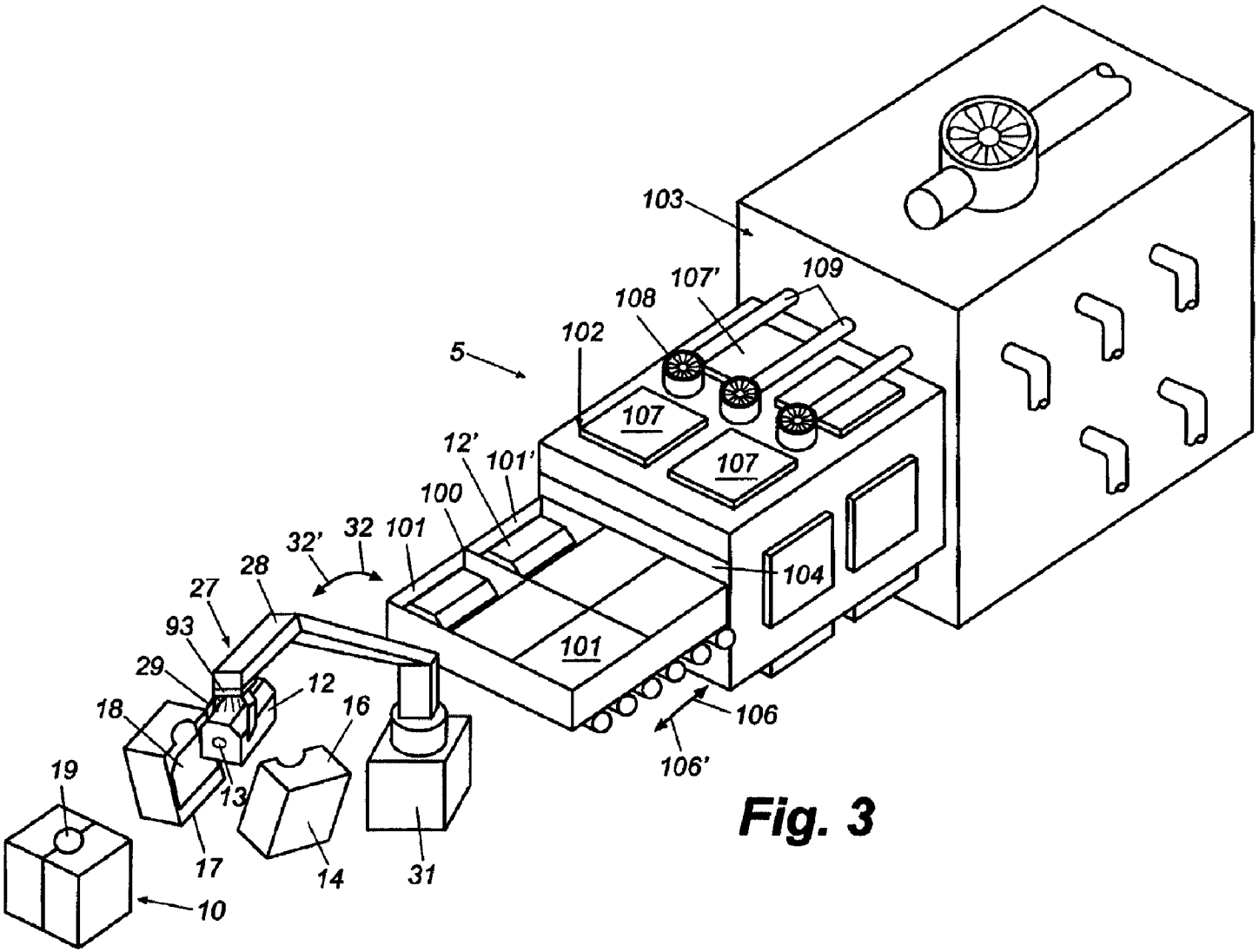
FIG. 3 is a perspective view of an alternate embodiment of the present invention in which the castings are fed through the process temperature control station in batches for feeding into the heat treatment station.

A first embodiment of the integrated facility 5 and process for moving and/or processing castings therethrough is illustrated in FIGS. 1A and 2A-2B. FIGS. 1B and 3 further illustrate an additional, alternative embodiment of the integrated facility 5 and process for forming and treating castings where the castings are being collected and processed through heat treatment in a batch processing type arrangement. It will, however, be understood by those skilled in the art that the principles of the present invention can be applied equally to batch type and continuous processing type facilities in which the castings are processed individually through the facility and therefore the present invention. The embodiments described hereinafter therefore are not and should not be limited solely to continuous or batch-type processing facilities. FIGS. 1C and 1D further illustrate alternative embodiments of the present invention for performing additional processing steps such as chill removal from castings (FIG. 1C) or feeding the castings to multiple heat treatment furnaces (FIG. 1D). In addition, it will be understood by those skilled in the art that various features of the embodiments discussed hereafter and illustrated in the drawings can be combined to form additional embodiments of the present invention.

In the embodiment illustrated in FIGS. 1A and 2A-2B, the castings 12 generally are removed from their molds 10 at the transfer or pouring station 11 by a transfer mechanism 27. As indicated in FIGS. 2A and 2B, the transfer system or mechanism 27 typically includes a robotic arm or crane, indicated at 28, although it will be understood by those skilled in the art that various other systems and devices for moving the castings and/or molds, such as an overhead boom or hoist, conveyor, pusher rods, or other similar material handling mechanisms, also can be used. As indicated in FIGS. 1A, 1B, and 2A, the robotic arm 28 of the transfer mechanism generally includes an engaging or gripping portion or clamp 29 for engaging and holding the molds or castings, and a base 31 on which the arm 28 is pivotally mounted so as to be movable between the transfer point 24 of the pouring station and the heat treatment line as indicated by arrows 32 and 32' (FIG. 2A). In addition, as shown in FIG. 1B, the transfer mechanism can be used to transfer molds and/or castings from multiple pouring stations 11 and 11' and can transfer the molds and/or castings to multiple heat treatment lines or units 26 (FIG. 1C).

The molds with their castings therein, typically are moved from the pouring station 11 to the pickup or transfer point 24 as shown in FIG. 2A whereupon the transfer mechanism 27 generally will pick up the molds with their castings contained therein, or will remove the castings 12 from their molds and transport the castings to the heat treatment unit 26. Thus, the same manipulator or transfer mechanism can be used for removing the castings from the pouring station and for introducing the castings to the heat treatment unit. Typically, a heat source or heating element 33 will be positioned adjacent the transfer point 28 for the castings for applying heat thereto. The heat source typically can include any type of heating element or source such as conductive, radiant, infrared, conductive, convective and direct impingement types of heat sources. As illustrated in FIG. 2A, multiple heat sources 33 can be used, positioned so as to most effectively apply heat to the castings during a transfer operation from the pouring station to the heat treatment line.

Typically, in the case of permanent or metal dies or molds, the molds will be opened at the transfer point and the castings removed by the transfer mechanism, as shown in FIG. 1D. The transfer mechanism then transfers the castings to one or more inlet conveyors 34 (FIGS. 1B and 2A) of the heat treatment unit, line(s) or system(s) 26 of the integrated processing facility 5. As the molds are opened and the castings removed, the heat sources 33 (FIG. 2A) apply heat directly to the castings to arrest or otherwise control the cooling of the castings during their exposure to the ambient environment of the foundry or plant, as the castings are being transferred to the heat treatment unit, so as to maintain the castings approximately at or above the process control temperature of the metal of the castings.

For the processing of castings that are being formed in semi-permanent or sand molds in which the castings typically remain within their molds during heat treatment, during which the molds are broken down by the thermal degradation of the binder material holding the sand of the mold, the transfer mechanism 27 will transfer the entire mold with the casting contained therein, from the transfer point to the inlet conveyor 34. The heat sources 33 thus will continue to apply heat to the mold itself, with the amount of heat applied being controlled to maintain the temperature of the castings inside the mold at levels approximately at or above the process control temperature of the metal of the castings without causing excessive or premature degradation of the molds.

Hereinafter, when reference is made to transport, heating, treating, or otherwise moving or processing the "castings", except where otherwise indicated, it will be understood that such discussion includes both the removal and processing of the castings by themselves, without their molds, and processes wherein the castings remain in their sand molds for heat treatment, mold and core breakdown, and sand reclamation as disclosed in U.S. Pat. Nos. 5,294,994; 5,565,046; 5,738,162, and 6,217,317 and pending U.S. patent application Ser. No. 09/665,354, filed Sep. 9, 2000, the disclosures of which are incorporated herein by reference.

As illustrated in FIGS. 1A and 2A-2B, the castings initially are indexed or conveyed by the inlet conveyor 34 (FIGS. 2A and 2B), or conveyors 34 and 34' (FIG. 1B) into a pre-chamber or process temperature control station or module 36. As indicated in FIGS. 2A and 2B, the process temperature control station or module generally includes a heated inner chamber 37 through which the castings and/or molds with the castings therein are conveyed along their processing path along the heat treatment line on a chain conveyor, rollers or similar conveying mechanism 38. The castings enter the chamber 37 at an upstream or inlet end 39, and exit the chamber 37 through a downstream or outlet end 41 and generally are introduced directly into a heat treatment furnace or station 42 of the heat treatment line 26. The inlet and outlet ends 39 and 41 of the process temperature control station further can be open, or can include doors or similar closure structures, such as indicated at 43 in FIG. 2B, to help seal the chamber 37 to avoid undue loss of heat therein. Typically, the castings will be fed directly from the process temperature control station 36 into the heat treatment station 42, with the heat treatment and process temperature control stations thus being linked together to further avoid potential loss of heat and possibly enable sharing of heat.

The chamber 37 generally is a radiant chamber and includes a series of heat sources 45 mounted therewithin, including being positioned along the walls 46 and/or ceiling 47 of the chamber. Typically, multiple heat sources 45 will be used and can comprise one or more various different types of heat sources or heating elements, including radiant heating sources such as infrared, electromagnetic or inductive energy sources, conductive, convective, and direct impingement type heat sources, such as gas fired burner tubes introducing a gas flame into the chamber. In addition, the side walls and ceiling of the radiant chamber 37 generally are formed from or are coated with a high temperature radiant material, such as a metal, metallic film or similar material, ceramic, or composite material capable of radiating heat and which generally forms a non-stick surface on the walls and ceilings. As a result, as the walls and ceiling of the chamber are heated, the walls and ceiling tend to radiate heat toward the castings, while at the same time their surfaces generally are heated to a temperature sufficient to burn off waste gases and residue such as soot, etc., from the combustion of the binders of the sand molds and/or cores to prevent collection and buildup thereof on the walls and ceiling of the chamber.

Figure 4A:
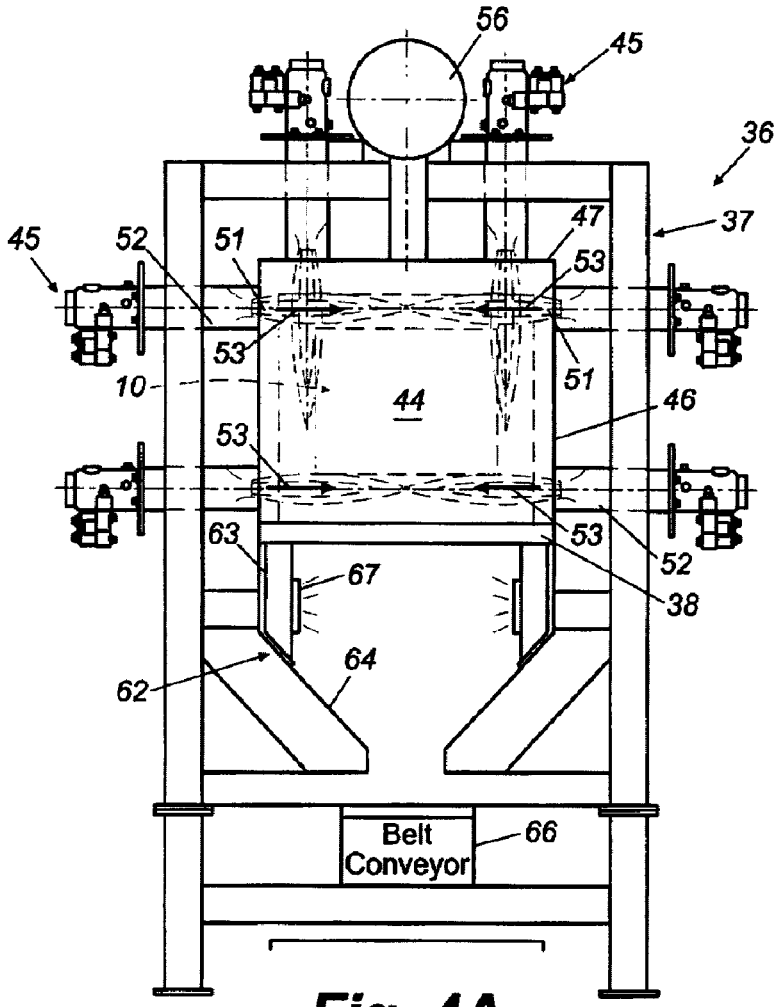
FIGS. 4A and 4B illustrate a first embodiment of the process temperature control module or station, utilizing a convection heat source.
Figure 4B:
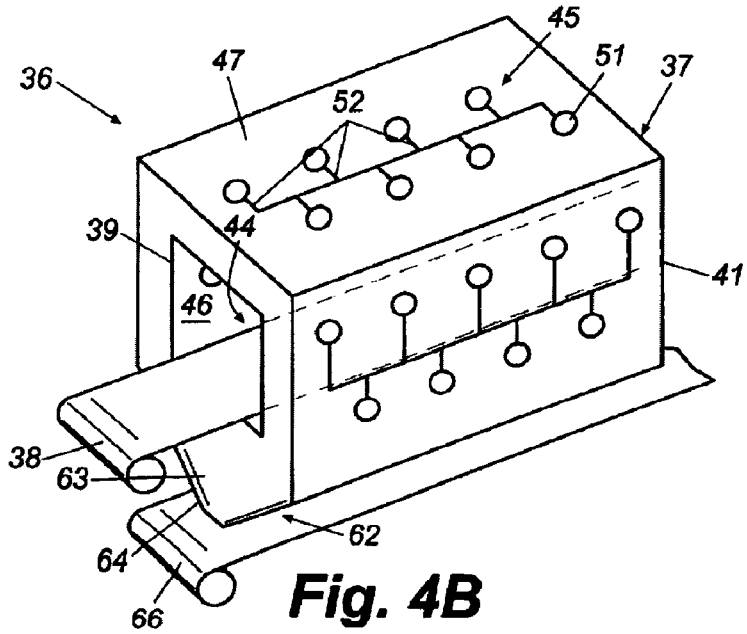

FIGS. 4A-6B illustrate various different embodiments of the process temperature control station. FIGS. 4A-4B illustrate the process temperature control station 36 utilizing convection type heat sources 45. Each of the convection heat sources generally includes one or more nozzles or blowers 51 connected to a source of heated media by conduits 52. The blowers 51 are arranged or positioned about the ceiling 47 and side walls 46 of the chamber 37 so as to direct a heated media such as air or other gases, and/or fluids into the chamber and against the castings and/or molds contained therein. The convection blowers generally tend to create a turbulent heated fluid flow about the castings, as indicated by arrows 53, as to apply heat substantially to all sides of the castings and/or sand molds. As a result, the castings are substantially uniformly bathed in the heated media so as to thus maintain the temperature of the castings approximately at or above the process control temperature of the metal thereof. In addition, where the castings are processed in their sand molds, the application of heat within the process temperature control station tends to heat the molds themselves, raising their temperature towards a decomposition or combustion temperature at which the binder materials therein start to combust, pyrolyze or otherwise be driven off.

It is also possible to have the blowers or nozzles 52 at the front of the process temperature control station adjacent the inlet end thereof, operating at higher velocities and/or temperatures to try to more quickly arrest the cooling of the castings and/or molds. The nozzles or blowers 52 positioned toward the middle and/or end of the chamber, such as at the outlet, of the process temperature control station can be run at lower temperatures and velocities so as to maintain a desired temperature level of the castings and/or sand molds to prevent complete degradation of the sand molds while still in the process temperature control station and to enable the solidification of the castings to be completed prior to heat treatment.

Figure 5A:
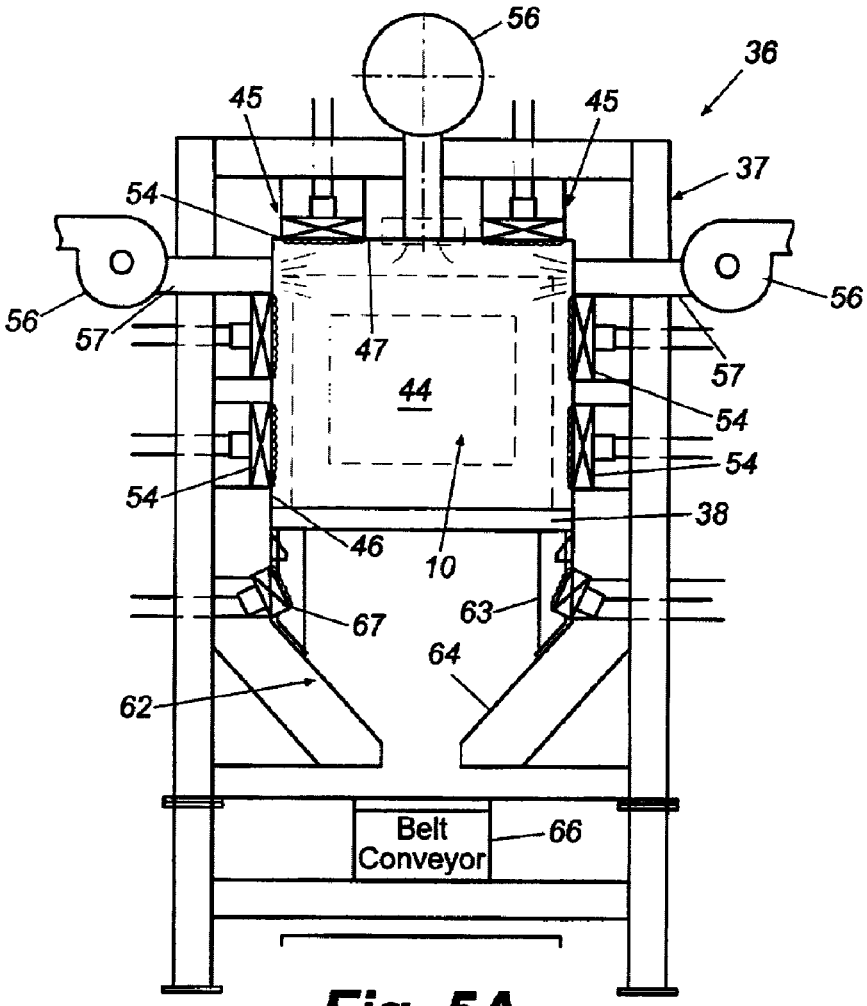
FIGS. 5A and 5B illustrate an additional embodiment of the process temperature control module or station, utilizing a direct heat/impingement heat source.
Figure 5B:
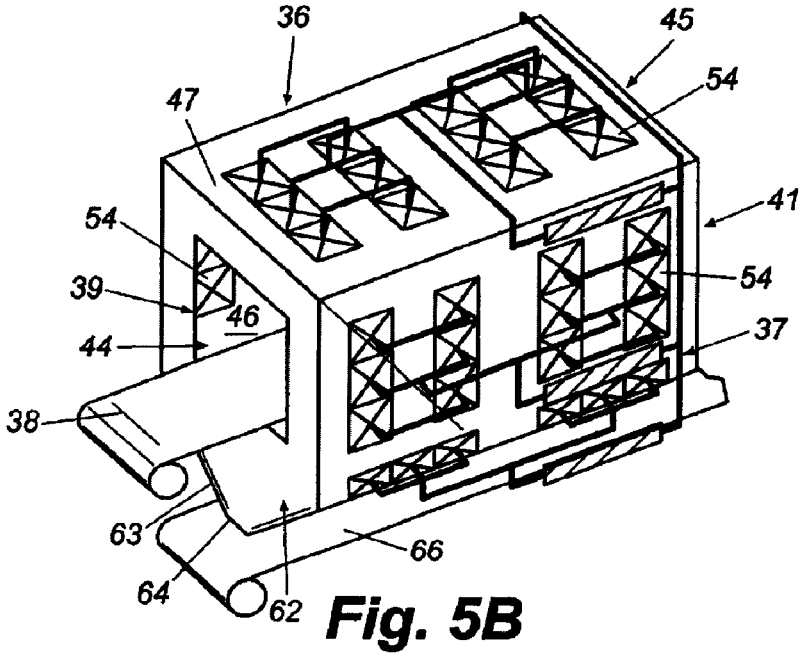

Alternatively, FIGS. 5A and 5B illustrate another embodiment of the process temperature control station 36' in which the heat sources 45' generally comprise one or more radiant heaters 54, such as infrared heating elements, electromagnetic energy sources, or similar radiant heating sources. Typically, the radiant heaters 54 will be arranged in multiple positions or sets at desired locations and orientations about the walls and ceiling 46 and 47 of the radiant chamber 37 of the process temperature control station 36, similar to the arrangement of the convection blowers 51. As with the convection heat sources 52, the radiant heaters adjacent the inlet end of the chamber can be operated at higher temperatures to more quickly arrest the cooling of the castings in their sand molds as they enter the process temperature control station. In addition, vacuum blowers, pumps or exhaust fans/systems 56 generally are connected to the radiant chamber through conduits 57 and create a negative pressure within the radiant chamber 37, so as to draw off heat and/or waste gases generated from the burning or combustion of the binder of the sand cores and/or sand molds within the chamber to help cool and prevent overheating of the elements of the radiant heaters.

Figure 6A:
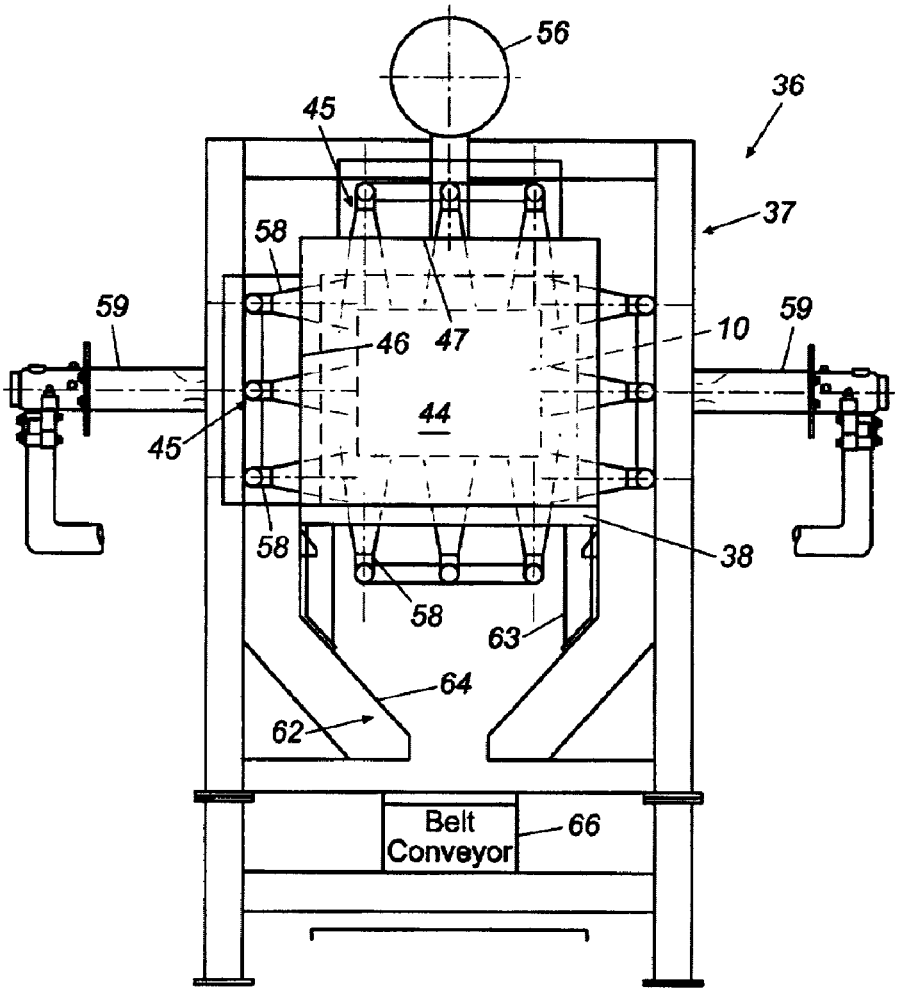
FIGS. 6A and 6B illustrate an additional embodiment of the process temperature control module or station, utilizing a radiant heat source.
Figure 6B:
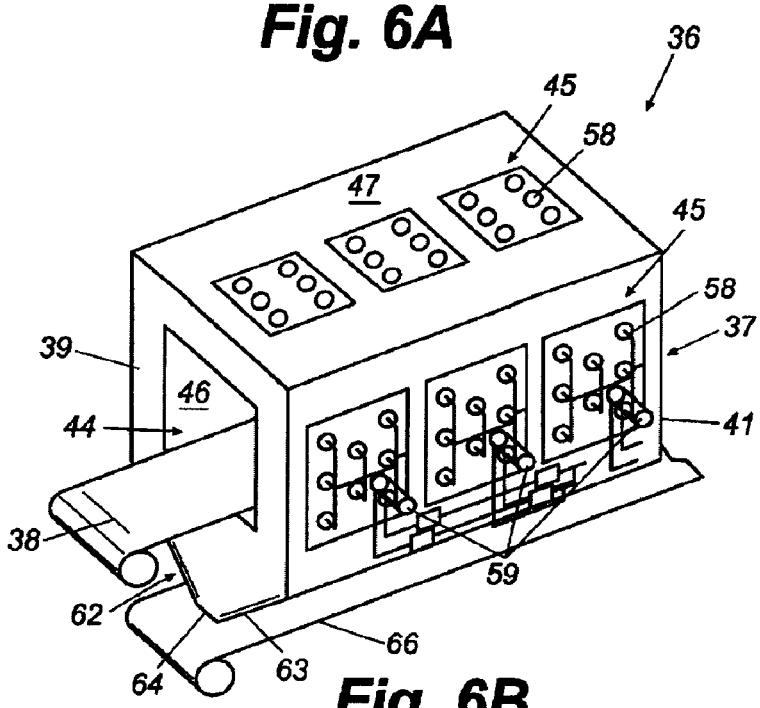

Still a further alternative embodiment of the process temperature control station 36" is illustrated in FIGS. 6A and 6B, which illustrate a direct impingement type of heating source 45". The direct impingement heat source includes a series of burners or nozzles 58 arranged in sets or arrays at selected positions or orientations within the radiant chamber 37. These burners 58 are generally connected to a fuel source, such as natural gas or the like, by conduits 59. The nozzles or burner elements of the direct impingement heat source direct and apply heat substantially toward the sides, the top, and the bottom of the castings. The castings are thus substantially uniformly heated, and the sand material released therefrom further can be exposed to direct heating for burning off of the binder material thereof.

It further will be understood by those skilled in the art that these different heating sources can be combined for use in the radiant chamber. Further, multiple chambers can be used in series for arresting the cooling of the castings at or above the process control temperature therefor and thereafter maintaining the temperature of the castings as they are queued for input into the heat treatment station.

In addition to the use of various types of heat sources, it is further possible as indicated in FIG. 1A to direct and/or recuperate off-gases generated and captured during the pouring of the molten metal material into their molds in the pouring station 11, into the radiant chamber of the process temperature control station 36, as indicated by arrows 60, in order to allow for shared heating and recuperation of energy from the heating of the metal for the castings. Alternatively, excess heat generated as a result of the break-down and combustion of the binder for the sand cores of the castings and/or sand molds within the heat treatment station 42 and the heat treatment of the castings also can be routed back to the process temperature control station, as indicated by dashed arrows 61 in FIG. 1A, in order to help heat the interior environment of the radiant chamber of the process temperature control station. Such recapture of waste gases and heat helps reduce the amount of energy required to heat the chamber of the process temperature control station to a desired or necessary temperature to arrest the cooling of the castings passing therethrough.

As additionally indicated in FIGS. 2B, 4A, 5A and 6A, a collection hopper or chute 62 generally is formed along the bottom of the process temperature control station 36, positioned below the radiant chamber 37 thereof. This hopper 62 generally includes side walls 63 that slope downwardly at the lower ends 64 thereof. The sloping side walls collect sand dislodged from the sand cores of the castings and/or sand molds as the thermal degradation of the binder thereof begins within the process temperature control station. The sand typically is directed downwardly to a collection conveyor 66 positioned below the open lower end of the hopper 62. Typically, a fluidizing system or mechanism 67 is positioned along lower portions 64 of the walls of the hopper 62. The fluidizer(s) typically includes burners, blowers, distributors or similar fluidizing units, such as disclosed and claimed in U.S. Pat. Nos. 5,294,994; 5,565,046; and 5,738,162, incorporated herein by reference, that apply a flow of a heated media such as air or other fluids to the sand to promote further degradation of the binder to help break up any clumps of sand and binder that may be dislodged from the castings to help reclaim the sand of the sand cores and/or sand molds for the castings in a substantially pure form. The reclaimed sand is collected on the conveyor 66 and conveyed away from the process temperature control station.

In addition, as illustrated in FIGS. 1A, 2A-2B, 4A, 5A, and 6A, excess heat and waste gases generated by the combustion of the binder materials for the sand cores and/or sand molds of the castings can be collected or drawn out of the radiant chamber 37 of the process temperature control station 36 and routed into the heat treatment station 42 as indicated by arrows 68 in FIG. 1A. This channeling of excess heat and waste gases from the process temperature control station into the heat treatment station enables both the potential recouping of heat generated within the chamber of the process temperature control station and the further heating and/or combustion of waste gases resulting from the degradation of the binders of the sand molds and/or cores within the heat treatment chamber. As indicated in FIG. 1A, blowers or similar air distribution mechanisms 69 further generally are mounted along the heat treatment station and typically will draw off waste gases generated during the heat treatment of the castings and the resulting burn-off of the binder materials from the sand cores and/or sand molds of the castings. These waste gases are collected by the blowers and typically are routed to an incinerator 71 for further treating and burning these waste gases to reprocess these gases and reduce the amount of pollution produced by the casting and heat treatment process. It is also possible to utilize filters to further filter the waste gases coming from either the process temperature control station prior to their being introduced into the heat treatment station and/or or for filtering gases coming from the heat treatment station to the incinerator.

The process temperature control station consequently functions as a nesting area in front of the heat treatment station or chamber in which the castings can be maintained with the temperature thereof being maintained or arrested at or above the process control temperature, but below a desired heat treating temperature while they await introduction into the heat treatment station. Thus, the system enables the pouring line or lines to be operated at a faster or more efficient rate without the castings having to sit in a queue or line waiting to be fed into the heat treatment station while exposed to the ambient environment, resulting in the castings cooling down below their process control temperature. The castings thereafter can be fed individually, as indicated in FIGS. 1A, 1C and 2A-2B, or in batches, as shown in FIGS. 1B, 1C and 3, into the heat treatment station 42 for heat treatment, sand core and/or sand mold breakdown and removal, and possibly for sand reclamation.

The heat treatment station 42 (FIG. 2B) typically is an elongated furnace that includes one or more furnace chambers 75 mounted in series, through which a conveyor 76 is extended for transport of the castings therethrough. Heat sources 77 (FIG. 2A) including convection heat sources such as blowers or nozzles that apply heated media such as air or other fluids, conduction heat sources such as a fluidized bed, inductive, radiant and/or other types of heat sources will be mounted within the walls and/or ceiling of the chamber 75 for providing heat and possibly an airflow about the castings in varying degrees and amounts in order to heat the castings to the proper heat treating temperatures for the metal thereof. Such desired heat treating temperatures and heat treatment times will vary according to the type of metal or metal alloy from which the castings are being formed, as will be known to those skilled in the art.

An example of a heat treatment furnace for the heat treatment and at least partial breakdown and removal of the sand cores and/or sand molds of the castings, and possibly for reclamation of the sand from the sand cores and molds is illustrated in U.S. Pat. Nos. 5,294,994; 5,565,046; and 5,738,162, the disclosures of which are hereby incorporated by reference. A further example of a heat treatment furnace or station for use with the present invention is illustrated and disclosed in U.S. patent application Ser. No. 09/313,111, filed May 17, 1999, and Ser. No. 09/665,354, filed Sep. 9, 2000, the disclosures of which are likewise incorporated herein by reference. Such heat treatment stations or furnaces further generally enable the reclamation of sand from the sand cores and/or sand molds of the castings, dislodged during heat treatment of the castings.

After heat treating, the castings generally are then removed from the heat treatment station and moved to a quenching station 78 (FIG. 1A) for quenching the castings where they can be cleaned and further processed. The quenching station typically includes a quench tank having a cooling fluid such as water or other known coolant, or can comprise a chamber having a series of nozzles that apply cooling fluids such as air, water or similar cooling media as is known in the art. Thereafter, the castings will be removed from the quenching station for cleaning and further processing as needed.

An additional embodiment of the integrated facility 5 is illustrated in FIG. 1B. In this embodiment, the transfer mechanism 27, here illustrated as a crane or robotic arm 28, removes the castings from multiple pouring lines or stations 11 and 11', here illustrated as a carousel type system in which the molds are rotated between pouring or casting positions 23 and a transfer point 24 at which the transfer mechanism 27 either engages and transports the sand molds with their castings therein or removes the castings from the molds and transfers the castings to one or more inlet conveyors 34 and 34' of the heat treatment unit 26. The castings can be individually moved into and through the process temperature control station 36 for introduction into the heat treatment station 42, or can be collected in baskets or conveying trays 79 for processing the castings in batches.

In the embodiment illustrated in FIG. 1B, the process temperature control station 36 generally is formed as an elongated radiant tunnel 81 defining a chamber 82 through which the castings and/or sand molds with castings contained therein are moved or conveyed. The radiant tunnel 81 generally includes a series of heat sources 83 mounted therealong, such as the various different heating sources 45, 45', and 45" discussed above with respect to the embodiments of FIGS. 2A-2B and 4A-6B. Typically, the walls 84 and ceiling of the chamber 82 of the radiant tunnel 81 are formed from or are coated with a refractory material so that the heat generated within the radiant tunnel is reflected/radiated towards the castings as they are moved therealong. At the end of the radiant tunnel 81 is a collection station 86 where the castings can be collected and/or deposited into a basket 79 or similar conveying tray for batch processing of the castings, or sand molds with castings contained therein, through the heat treatment station 42. The collection of the castings within the baskets for batch processing in the heat treatment station also can be done before the castings are passed through the radiant chamber or tunnel of the process temperature control station 36, as indicated in FIGS. 1C and 3.

Still a further embodiment of the integrated facility 5 of the present invention is schematically illustrated in FIG. 1C. In this embodiment, the process temperature control station 36, here indicated as comprising an elongated radiant tunnel or chamber 81 (as discussed with respect to FIG. 1B), connects or feeds into a chill removal station 87, which is in communication with and feeds the castings into the heat treatment station 42. Typically, in this embodiment the castings will be moved and heat-treated or processed while still contained within their semi-permanent or sand molds, which further include "chills" mounted therein. Chills generally are metal plates, typically formed from steel or similar material, having a design relief for forming desired design features of a casting surface and are placed within the molds at or prior to the pouring of the molten metal material therein. The chills consequently must be removed prior to heat treatment of the castings or reclamation of the chills and reuse. After passing through the chamber 82 of the radiant tunnel 81 during which the combustion of the sand molds generally will at least partially have begun, the chills can be easily removed therefrom without significantly delaying the movement of the molds and castings into the heat treatment station 42. Following the removal of the chills in the chill removal station, the molds with their castings within are generally passed directly into the heat treatment station for heat treatment, sand core and sand mold breakdown, and sand reclamation.

Still a further alternative embodiment of the integrated facility of the present invention is illustrated in FIG. 1D. In this embodiment, the castings generally can be removed from their molds and transported to an inlet conveyor 90 or 91 for being fed directly into one or more heat treatment furnaces or stations 92. Alternatively, if the castings are being formed within sand molds, the entire mold will be transported from the transfer point 28 to one of the inlet conveyors 90 or 91. As indicated in FIG. 1D, the removal of the castings from their molds and subsequent transfer of the castings, or the removal of the molds with the castings remaining therein from the pouring station and transport to the heat treatment stations 92 generally can be done by the same transport mechanism or manipulator.

In this embodiment, a heat source 93 is shown mounted to the transfer mechanism 27 itself and applies heat directly to the castings and/or sand molds as the castings are moved from the transfer points of the pouring lines to one of the inlet conveyors 90 or 91 for a heat treatment furnace 92. The heat source, as discussed above, can include a radiant energy source such as infrared or electromagnetic emitters, inductive, convective, and/or conductive heat sources, or other types of heat sources as will become apparent to those skilled in the art. The heat from the heat source 93 mounted to the transfer mechanism 27 is generally directed at one or more surfaces such as the top and/or sides of the castings or molds as the castings or molds are transferred to the inlet conveyor so as to arrest the cooling of the castings and/or molds and thus maintain the temperature of the casting metal substantially at or above the process control temperature of the metal.

Additional heat sources, such as indicated at 94, can be mounted above or adjacent the inlet conveyors 90 and 91 as indicated in FIG. 1D, or along the paths of travel of the transfer mechanism as indicated by arrows 96 and 96' and 97 and 97' to maintain the heating and arresting of the temperature of the castings. In addition, blowers, fans or other similar air movement devices (not shown) also can be positioned adjacent the transfer mechanism or along its path of movement, indicated by arrows 96 and 96' and 97 and 97', for applying a heated media, such as air or other heated fluids for distributing the heat being applied to the casting and/or mold being transported substantially about the sides, top and bottom thereof, to try to reduce the incidence of cold spots and uneven heating or cooling of the castings during transfer from the pouring line to the heat treatment furnace (s) 92. The use of such heat sources or elements mounted on the transfer mechanism and, in some arrangements, along the path of travel of the castings, thus perform the function of the process temperature control station to help arrest and maintain the castings at or above the process control temperature therefore.

As illustrated in FIG. 3, in still a further embodiment of the integrated metal processing facility, the castings and/or sand molds can be placed directly within collection baskets or conveying tray 100 by the transfer mechanism 27 for feeding into the process temperature control station as part of an overall batch heating process for the castings, as indicated in FIG. 3. In such an arrangement, the castings 12 generally will be loaded into a series of compartments or chambers 101 of the conveying tray 100, with the castings located in known, indexed positions for directed application of heat for de-coring and other functions as the castings are moved into and through a process temperature control station 102 and heat treatment station 103, as disclosed and claimed in U.S. patent application Ser. No. 09/665,354, filed Sep. 9, 2000, incorporated herein by reference. In this embodiment, the trays 100 typically will be indexed into and out of the chamber 104 of the process temperature control station as indicated by arrows 106 and 106' as the castings are loaded therein. As a result, the exposure of the castings to the ambient environment, which would allow them to cool down below their process control or critical temperature, is minimized while the various other compartments 101 of the tray are loaded with the remaining castings of the batch.

In addition, as indicated in FIG. 3, it is further possible to provide directed heat sources 107 for each of the compartments 101 of the trays 100. For example, as a first compartment 101' is loaded with a casting 12', and indexed into the process temperature control station 102 as shown in FIG. 3, a first heat source 107' will be engaged to apply heat directed specifically toward the casting and/or sand mold within that particular chamber. Thereafter, as successive castings or molds are loaded into the other chambers or compartments of the basket, additional heat sources 107 directed to those compartments are engaged. Thus, the heating of the chamber 104 of the process temperature control station can be limited or directed to specific regions or zones as needed for more efficient heating of the castings.

As FIG. 3 further illustrates, a series of blowers or other similar air movement devices 108 generally can be mounted to the roof of the process temperature control station for drawing off waste gases generated by the degradation of the sand core and/or sand mold binder materials, which gases and additional waste heat are then directed via conduits 109 into the heat treatment station 103 for heat reclamation and pollution reduction, as well as further helping to avoid the collection of combustible wastes on the sides and ceiling of the chamber of the process temperature control station 102.

It will be understood by those skilled in the art that while the present invention has been disclosed with reference to specific embodiment as disclosed above, various additions, deletions, modifications and changes can be made thereto without departing from the spirit and scope of the present invention. It will also be understood that the various embodiments and/or features thereof can be combined to form additional embodiments of the present invention.

What is claimed is:

1. A method of processing a cast metal comprising:

determining a process control temperature for a metal to be cast, wherein the process control temperature is a temperature below which for every one minute of time the temperature of the cast metal decreases, more than one minute of heat treatment is required to attain the desired properties of the cast metal, and the process control temperature is from about 400° C. to about 1300° C.;

pouring the metal in a molten state into a mold;

transferring the poured metal to a heat treatment unit including a heat treatment furnace;

heat treating the poured metal within the mold in the heat treatment furnace; and maintaining the temperature of the poured metal at or above the process control temperature and below a heat treatment temperature for the cast metal from the pouring until the heat treating, so as to allow the metal to solidify sufficiently to form a casting while enabling shorter heat treating times for the casting, wherein the maintaining includes monitoring the temperature of the poured metal within the mold and, in response to the monitoring, applying heat as needed to the poured metal within the mold.

2. A method of forming and treating a metal casting, comprising:

pouring a molten metal into a mold;

allowing solidification cooling of the molten metal to enable the molten metal within the mold to at least partially solidify to form a casting;

applying heat to the casting as needed to arrest cooling of the casting at a temperature at or above a process control temperature for the metal between pouring and heat treatment of the casting, wherein the process control temperature is less than a desired heat treatment for the metal and is a temperature below which for every one minute of time the temperature of the casting decreases, more than one minute of heat treatment is required to attain the desired properties of the casting, and the process control temperature is at least about 400° C.;

moving the casting into a heat treatment station including a heat treatment furnace;

applying heat to the casting to attain the desired heat treatment temperature for the casting; and heat treating the casting in the heat treatment furnace.

3. A method of forming and treating a metal casting, comprising:

pouring a molten metal into a mold;

allowing the molten metal within the mold to cool to a temperature sufficient to enable the molten metal to substantially solidify to form the casting;

maintaining the casting at or above a process control temperature for the metal of the casting, and below a solution heat treatment temperature for the casting to enable necessary solidification of the metal of the casting as the casting is moved from a pouring station and into a heat treatment furnace;

raising the temperature of the casting to the solution heat treatment temperature; and heat treating the casting in the heat treatment furnace, wherein the process control temperature is a temperature sufficient to enable a time for reheating of the casting to its solution heat treatment temperature to be substantially minimized but below which for every one minute of time the temperature of the casting decreases, more than one minute of heat treatment is required to attain the desired properties of the casting, and the process control temperature is less than the solution heat treatment temperature.

4. The method of claim 1, further comprising allowing the poured metal to at least partially solidify as the temperature of the poured metal is maintained at or above the process control temperature.

5. The method of claim 1, wherein maintaining the temperature of the casting at or above the process control temperature comprises moving the casting through a radiant chamber including a plurality of heating sources.

6. The method of claim 1, wherein the metal is an aluminum/copper alloy and the process control temperature is from about 400° C. to about 470° C.

7. The method of claim 1, wherein the metal is an iron alloy and the process control temperature is from about 1000° C. to about 1300° C.

8. The method of claim 2, wherein applying heat to the casting to arrest the cooling of the casting to a temperature at or above the process control temperature for the metal comprises moving the casting through a process temperature control station including a heating source.

9. The method of claim 8, wherein the heating source comprises a radiant heater, a convection heater, a burner connected to a fuel supply, or any combination thereof.

10. The method of claim 2, further comprising placing the casting within the mold into a conveying tray.

11. The method of claim 2, further comprising placing the casting within the mold into a conveying tray in a known, indexed position.

12. The method of claim 2, further comprising removing the casting from the mold after heat treating the casting.

13. The method of claim 2, further comprising removing the casting from the mold prior to heat treating the casting.

14. The method of claim 13, further comprising placing the casting removed from the mold into a conveying tray.

15. The method of claim 13, further comprising placing the casting removed from the mold into a conveying tray in a known, indexed position.

16. The method of claim 2, wherein the metal is an aluminum/copper alloy and the process control temperature is from about 400° C. to about 470° C.

17. The method of claim 2, wherein the metal is an iron alloy and the process control temperature is from about 1000° C. to about 1300° C.

18. The method of claim 3, wherein arresting the cooling of the molten metal and maintaining the casting at or above the process control temperature for the metal comprises moving the casting through a process temperature control station including a heating source.

19. The method of claim 3, wherein the metal is an aluminum/copper alloy and the process control temperature is from about 400° C. to about 470° C.

20. The method of claim 3, wherein the metal is an iron alloy and the process control temperature is from about 1000° C. to about 1300° C.

* * * * *